US008640283B2

(12) United States Patent
Broadley et al.

(10) Patent No.: US 8,640,283 B2
(45) Date of Patent: Feb. 4, 2014

(54) LEG RELEASE ASSEMBLY FOR A COT

(75) Inventors: Gavin Broadley, Coolum Beach (AU); Alan Cambridge, Wooloowin (AU)

(73) Assignee: Ferno-Washington, Inc., Wilmington, OH (US)

( * ) Notice: Subject to any disclaimer, the term of this patent is extended or adjusted under 35 U.S.C. 154(b) by 423 days.

(21) Appl. No.: 12/811,739

(22) PCT Filed: Jan. 7, 2009

(86) PCT No.: PCT/US2009/030312

§ 371 (c)(1),
(2), (4) Date: Sep. 22, 2010

(87) PCT Pub. No.: WO2009/089270

PCT Pub. Date: Jul. 16, 2009

(65) Prior Publication Data

US 2011/0018296 A1 Jan. 27, 2011

Related U.S. Application Data

(60) Provisional application No. 61/019,401, filed on Jan. 7, 2008.

(51) Int. Cl.
*A61G 1/02* (2006.01)
*A61G 1/06* (2006.01)

(52) U.S. Cl.
USPC ..... 5/611; 5/86.1; 296/20

(58) Field of Classification Search
USPC ..... 5/611, 86.1; 296/20
See application file for complete search history.

(56) References Cited

U.S. PATENT DOCUMENTS

| | | | | |
|---|---|---|---|---|
| 3,980,334 | A * | 9/1976 | Ferneau et al. | 296/20 |
| 4,921,295 | A * | 5/1990 | Stollenwerk | 296/20 |
| 5,015,024 | A * | 5/1991 | Bloemer | 296/20 |
| 7,100,224 | B2 * | 9/2006 | Knipfel | 5/620 |
| 7,424,758 | B2 | 9/2008 | Broadley et al. | |
| 2008/0258486 | A1 * | 10/2008 | Broadley et al. | 296/20 |

FOREIGN PATENT DOCUMENTS

| | | | |
|---|---|---|---|
| FR | 2664495 | A | 10/1990 |
| FR | 2800344 | A | 10/1999 |
| GB | 2 283 415 | A | 10/1995 |
| JP | 2007-532402 | A | 10/2005 |

OTHER PUBLICATIONS

Machine translation of FR266495A1.*
International Search Report, Application No. PCT/US2009/030312, 2 pages, Mar. 23, 2009.

* cited by examiner

*Primary Examiner* — Michael Trettel
(74) *Attorney, Agent, or Firm* — Dinsmore & Shohl LLP

(57) ABSTRACT

A cot operable to fold one or more legs thereof with the advancing of the cot onto a support object is disclosed. The cot comprises a wheeled transporter, having a frame and legs, and a leg release assembly. The leg release assembly comprises a contact member, a leg release member releasably engaged with at least one of the legs, and a linkage member operably connecting the contact member and the leg release member. The contact member is pressure-sensitive and activates with an application of pressure thereto. The leg release member releases the at least one of the legs from an engagement therewith with activation of the contact member. The at least one of legs folds relative to the frame with the release of the engagement with the leg release member.

16 Claims, 4 Drawing Sheets

LEG RELEASE ASSEMBLY FOR A COT

This application is the U.S. national stage entry under 35 USC §371 of International Application No. PCT/US2009/030312, filed Jan. 7, 2009, which claims the benefit under 35 U.S.C. §119(e) of U.S. Provisional Application 61/019,401, filed Jan. 7, 2008.

Embodiments of the present invention relate generally to emergency cots used to transport patients in emergency vehicles, and in particular, to roll-in cots comprising a wheeled transporter with collapsible legs and a leg release assembly to permit automatic collapsing of at least one of the collapsible legs.

Emergency cots of the roll-in type, referred to herein as cot or cots, are configured to be able to be rolled into various types of emergency vehicles, such as ambulances, vans, station wagons, modular type emergency vehicles, aircrafts, helicopters and the like. In order to be able to load the roll-in cot into such a vehicle, the cot generally is configured to provide load wheels at a similar height to that of a platform in the emergency vehicle.

Upon loading, leading and then trailing of legs of the roll-in cot are collapsed to be beneath a stretcher, or other patient support, of the roll-in cot. Although the load wheels take up the weight at the leading end of the cot as the leading leg folds, an operator is still required to support a portion of the weight of both the patient and the roll-in cot at the trailing end of the cot as the roll-in cot is further pushed onto the platform after collapsing the trailing leg. The ability of the operator to both support and push the cot during loading is further complicated by the operator needing to operate a handle to cause the collapse or folding of pivoting legs.

In many configurations of emergency cots, both the leading and trailing legs are generally collapsed by operating a single handle that then requires the operator to support the trailing end of the emergency cot for a substantial period during loading. In other configurations, separate handles have been provided for the leading and trailing legs. The provision of separate handles for operation of the leading and trailing legs allows the leading leg to be activated initially by operation of its respective handle and the cot pushed further onto the platform and be supported on wheels attached to the leading leg at an intermediate position prior to the folding of the trailing leg. In this manner, the operator is required to support a lesser weight as more of the weight of the cot and patient is supported on the platform and the trailing leg and the moment of force is also reduced. However, the added complexity in operating the respective handles in sequence during the loading of a patient into an emergency rescue vehicle is often cumbersome and may result in the respective handles being operated out of sequence, thereby causing the operator to have to unexpectedly support the weight of the patient and the cot.

It is against the above background that the present invention provides a cot that enables simplified collapsing of the leading and trailing legs in a desired sequence and that overcomes or ameliorates one or more of the disadvantages described above.

In accordance with one embodiment of the present invention, a cot comprises a wheeled transporter and a leg release assembly. The wheeled transporter comprises a frame, a leading leg pivotally connected to the frame, and a trailing leg pivotally connected to the frame. The leg release assembly comprises a contact member pivotally connected to the wheeled transporter, a pivotal leg release member releasably engaged with at least one of the leading leg and the trailing leg, and a linkage member operably connecting the contact member and the leg release member. The contact member is pressure-sensitive and activates with an application of pressure thereto. The leg release member pivots to disengage from the at least one of the leading leg and the trailing leg with activation of the contact member. The at least one of the leading leg and the trailing leg folds relative to the frame with disengagement from the leg release member.

These and other features of various embodiments of the present invention will become apparent from the below detailed discussion and along with the following drawings.

The following detailed description of various embodiments of the present invention can be best understood when read in conjunction with the following drawings, where like structure is indicated with like reference numerals and in which.

Figure 1:
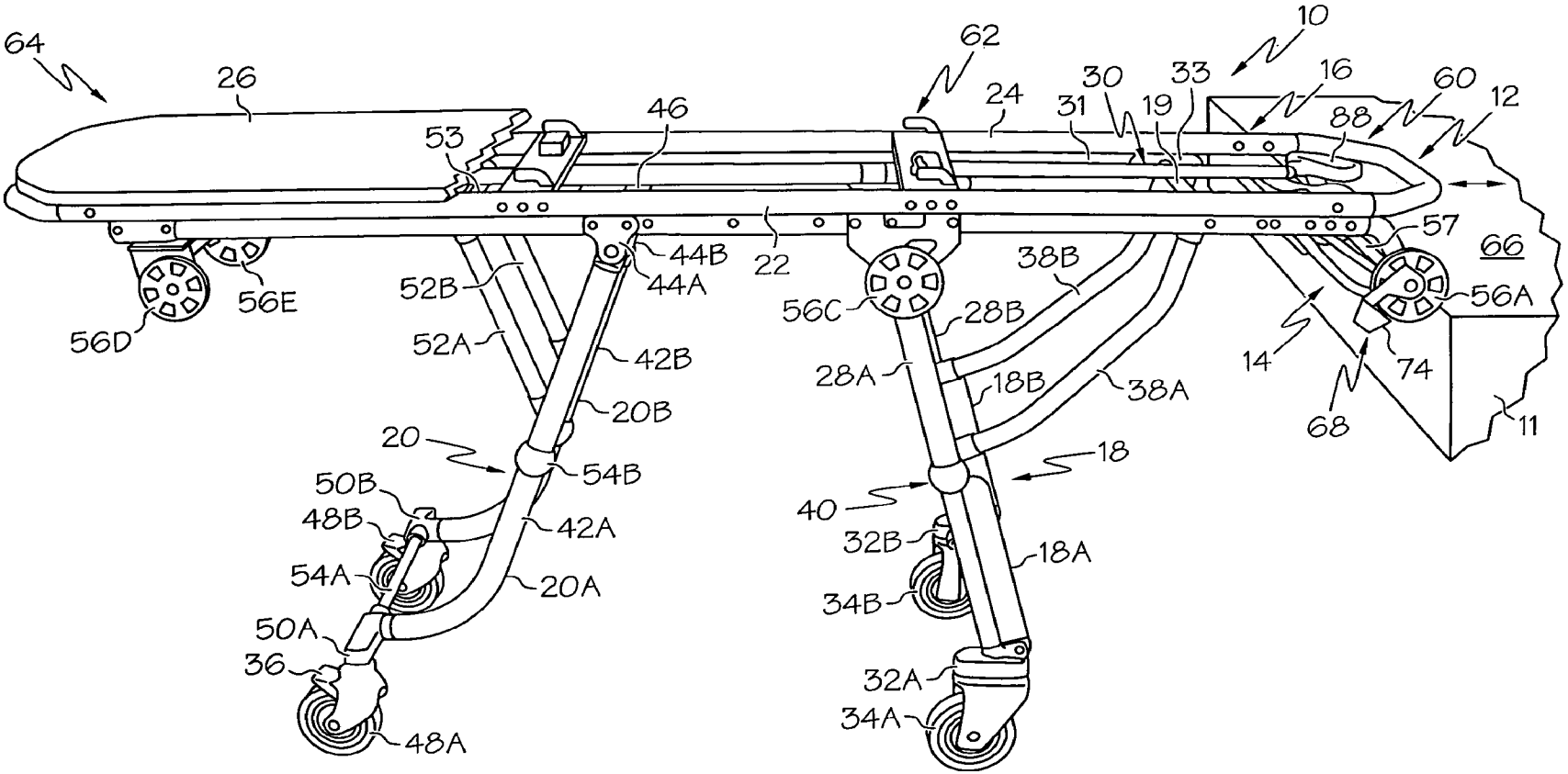
FIG. 1 is a side perspective view of a cot according to one embodiment of the present invention.

The embodiments set forth in the drawings are illustrative in nature and are not intended to be limiting of the invention defined by the claims. Moreover, individual aspects of the drawings and the invention will be more fully apparent and understood in view of the detailed description.

Embodiments of the present invention relate generally to roll-in cots for patient transport in emergency vehicles. Referring initially to FIG. 1, a cot 10 is illustrated in which the legs thereof are extended. The cot 10 comprises a wheeled transporter 12 and a leg release assembly 14. The wheeled transporter 12 is operable to facilitate maneuvering of the cot 10, particularly into and out of an emergency vehicle 11. The wheeled transporter 12 comprises a frame 16, leading legs 18, trailing legs 20, and a pair of opposed side frame members 22, 24. The frame 16 is supported by the leading and trailing legs 18, 20 and may be provided in one of any variety of configurations. The cot 10 also may comprise a patient support 26 that may be mounted on a top of the frame 16 so that the cot 10 may be used to transport patients. The patient support 26 may be in the form of a detectable stretcher or in the form of a segmented stretcher permanently fixed to the frame 16 of the cot 10. The frame 16 also may include provisions, such as, but not limited to, clamps, clasps, recesses, channels, etc., for the attachment of medical appliances or other devices thereto that may be associated with patient transport. For example, the frame 16 may include a receptacle for holding an oxygen cylinder or heart monitoring equipment. In addition, the frame 16 generally comprises a leading trolley assembly 30 and a trailing trolley assembly that facilitate the pivoting of the leading and trailing legs 18, 20, as described in greater detail below. Further, the frame 16 may be adjustable in height so as to facilitate a loading of the cot 10 into an emergency vehicle. For example, respective lengths and/or positions of the leading and trailing legs 18, 20 may be adjusted to vary the height of the frame 16 relative to a surface.

The leading and trailing legs 18, 20 generally respectively comprise a pair of legs 18A, 18B and 20A, 20B to provide stability to the cot 10, particularly when supporting a patient. It is contemplated, however, that the wheeled transporter 12 may comprise a single leading leg 18 with a pair of trailing legs 20A, 20B, a single trailing leg 20 with a pair of leading legs 18A, 18B, or both a single leading leg 18 and a single trailing leg 20. Further, in one embodiment, a pair of leading legs 18A, 18B are spaced apart by a greater or lesser distance than a pair of trailing legs 20A, 20B such that, when collapsed relative to the frame 16, the leading and trailing legs 18, 20 assume a nested orientation. It also is contemplated, however, that the leading and trailing legs 18, 20 may fold in a forward direction or in a rearward direction.

The leading and trailing legs 18, 20 are pivotally connected generally to an underside of the frame 16. Thereby, the leading and trailing legs 18, 20 may pivot to fold and extend relative to the frame 16, as described in greater detail herein. In one embodiment, respective pairs of the leading and trailing legs 18, 20 are connected to the frame 16 with a bar that extends a width of the frame 16 and through respective ends of the respective pairs of legs 18, 20 proximal to the frame 16. In addition, the respective pairs of legs 18, 20 may be stabilized with respective bracing members that extend between each leg of the respective pairs of legs 18, 20. Further, the respective legs 18, 20 may be splayed, i.e. a pair of leading legs 18 is angled forward and a pair of trailing legs 20 is angled rearwards. Also, a strut may extend from the respective pairs of legs 18, 20 that strut may engage the frame 16 to retain the legs 18, 20 extended relative to the frame 16. It is also contemplated that the legs 18, 20 may extend vertically from the frame 16.

As shown in FIG. 1, the leading legs 18A, 18B may respectively comprise a leading support member 38A, 38B with respective ends thereof proximal to the frame 16 pivotally mounted on a cross bar 19. In one embodiment, the cross bar 19 is supported on each end via a leading trolley assembly 30. Each trolley assembly 30 is slidably mounted to a respective track 31. Each track 31 is mounted to the frame 16 generally along the interior facing side of the side frame members 22, 24. Each leading trolley assembly 30 has a support mount 33 to which a respective end of the cross bar 19 is supported. Each support mount 33 pivotably mounts rollers or wheels 35 (shown by FIG. 4) that are in turn supported by the respective rail 31.

Figure 4:
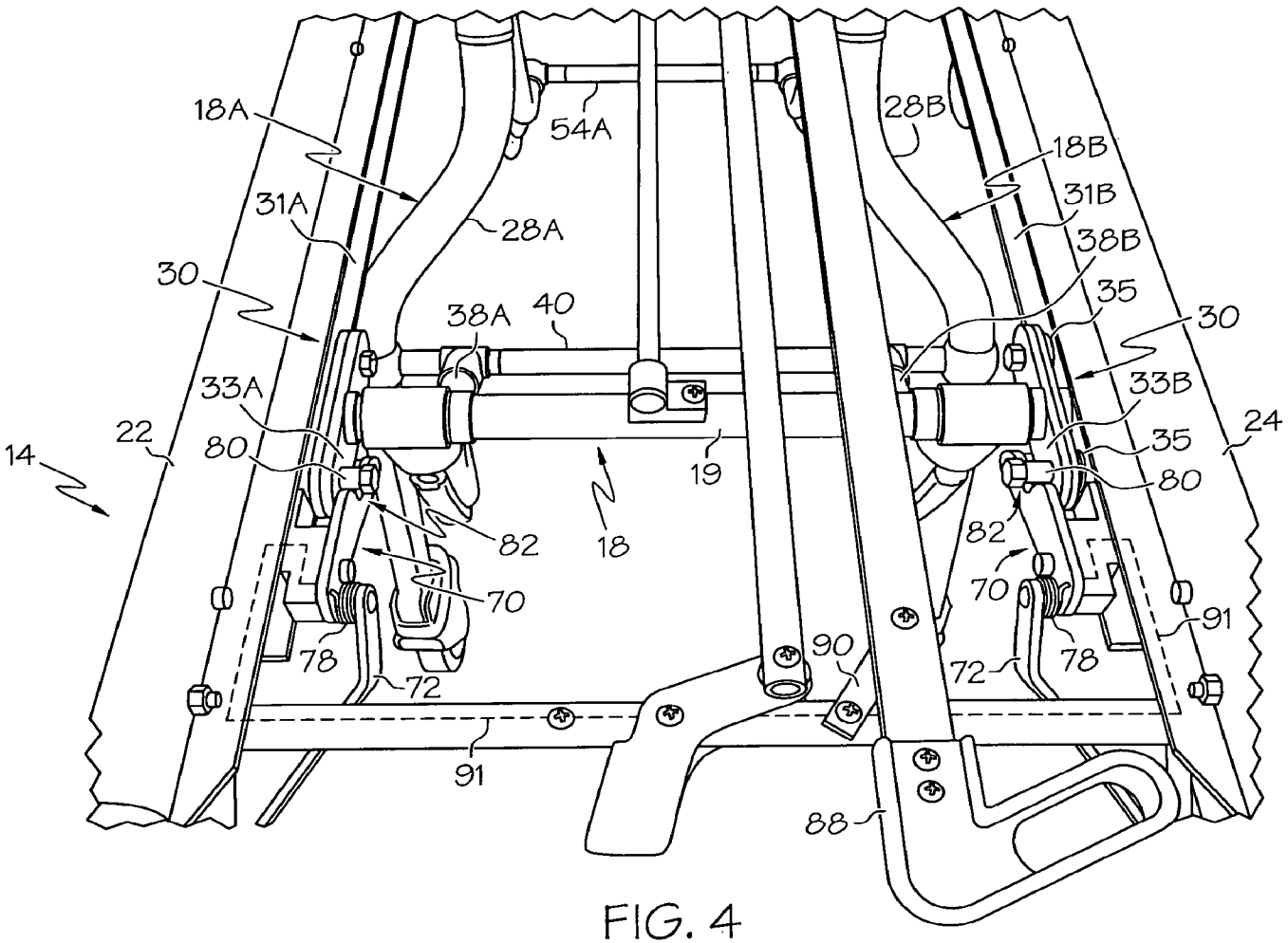
FIG. 4 is a top perspective view of a leg release member of a leg release assembly of a cot according to another embodiment of the present invention.

As best shown by FIG. 4, the leading support members 38A, 38B, at their respective ends distal from the frame 16 are pivotably mounted to a cross-support 40 which is mounted between respective leading frame members 28A, 28B of the leading legs 18A, 18B. Respective ends of the leading frame members 28A, 28B proximal to the frame 16 may be pivotally connected to the frame 16 via a hinge or other pivotal or rotatable fitting so that as the leading support members 38A, 38B pivot about cross bar 19, via sliding movement of the trolley assemblies 30A, 30B along through respective tracks 31A, 31B, the proximal ends of the leading frame members 28A, 28B pivot about the hinge to fold or extend the leading legs 18A, 18B relative to the frame 16. In one embodiment, a crossbar (not shown) may extend a width of the frame 16 to connect the proximal ends of the leading frame members 28A, 28B in a manner similar to which ends of leading support members 38A, 38B are pivotably mounted to cross bar 19 and to provide additional support to the wheeled transporter 12. Further, respective ends of the leading frame members 28A, 28B distal from the frame 16 may be connected with leading fittings 32A, 32B to leading wheels 34A, 34B. The leading wheels 34A, 34B may be conventional caster wheels, or other wheels, with foot-operated locking members 36.

It is to be appreciated that the trolley assemblies 30 may slide bi-directionally along the track 31. In this manner, with a collapsing of the leading legs 18A, 18B, the support members 33A, 33B, connected thereto via cross bar 19, in a released condition slide along the tracks 31A, 31B from a position proximal to the leading end 60 of the frame 16 to about a position along the track 31, which is generally indicated by symbol 62, so that the leading legs 18A, 18B are collapsed under the frame 16. Conversely, extending the legs 18A, 18B, such as when removing of the cot 10 from the emergency vehicle 11, results in the support members 33A, 33B to slide along their respective tracks 31A, 31B, until returning to a secured condition shown by FIG. 4, thereby securing the cot 10 in the elevated condition shown by FIG. 1.

Likewise, as shown in FIG. 1, the trailing legs 20A, 20B may respectively comprise a trailing support member 52A, 52B with respective ends thereof proximal to the frame 16 pivotally mounted on trailing cross bar 53 which is mounted between a pair of trailing trolley assemblies (not shown). As the trailing trolley assemblies are similar to the leading trolley assemblies 30, for the sake of brevity, no further disclosure is provided. In addition, each trailing trolley assembly utilizes a track (not shown) similar to track 31 such that each trailing trolley assembly may slide or otherwise move bi-directionally along the track 31. Thereby, the trailing support members 52A, 52B of the trailing legs 20A, 20B may pivot about the cross bar 53 as the cross bar 53, via the trailing trolley assemblies, moves along the tracks. In this manner, with extension of the trailing leg 20, the trailing trolley assemblies slide or otherwise move along the tracks from a position proximal to the trailing end 64 of the cot to where at least one leg release member, such as similar to leading leg release member 70 (FIG. 4), engages a respective trolley assembly, thereby securing the trailing leg 20 in the extended state relative to the frame 16 as shown by FIG. 1. Conversely, with a collapsing of the trailing leg 20, the trailing trolley members operably connected thereto slide or otherwise move along their respective track to proximal to the trailing end 64 of the frame 16 so that the trailing leg 20 is collapsed under the frame 16. The trailing support members 52A, 52B may be connected at their respective ends distal from the frame 16 to respective trailing frame members 42A, 42B of the trailing legs 20A, 20B.

In one embodiment, respective ends of the trailing frame members 42A, 42B proximal to the frame 16 may be pivotally connected to the frame 16 via a hinge 44A, 44B or other pivotal or rotatable fitting so that as the trailing support members 52A, 52B pivot along the track 31, the proximal ends of the trailing frame members 42A, 42B pivot about the hinge 44A, 44B to fold or extend the trailing legs 20A, 20B relative to the frame 16. In another embodiment, a crossbar 46 may extend a width of the frame 16 to connect the proximal ends of the trailing frame members 42A, 42B and the respective hinges 44A, 44B to provide additional support to the wheeled transporter 12. Further, respective ends of the trailing frame members 42A, 42B distal from the frame 16 may be connected with trailing fittings 50A, 50B to trailing wheels 48A, 48B. The trailing wheels 48A, 48B may be conventional caster wheels, or other wheels, with foot-operated locking members 36. In addition, the trailing legs 20A, 20B may comprise trailing cross-supports MA, MB to provide added strength and stability to the trailing legs 20A, 20B. In one embodiment, the respective ends distal from the frame 16 of the trailing support members 52A, 52B are pivotably connected to cross-support 54B.

As shown in FIG. 1, the wheeled transporter 12 may further comprise one or more cot supports 56A, 56B, 56C, 56D, 56E. The cot supports 56A, 56B may mounted to the frame 16 with conventional support mounts 58 on side frame members 22, 24 proximal to the leading end 60 of the frame 16 and may be connected with an axle 57. It is contemplated that the axle 57 need not necessarily extend completely from one side frame member 22, 24 to the other side frame member 22, 24. In the illustrated embodiment, the cot supports 56A, 56B comprise loading wheels. It is contemplated, however, that, in other embodiments, the cot supports 56A, 56B may comprise rollers, skid blocks, rails, bump plates, etc. Cot supports may be provided proximal to a midsection 62 of the frame 16 and/or to the trailing end 64 of the frame 16 in addition to or in the alternative to the cot supports 56A, 56B provided proximal to the leading end 60 of the frame 16. The cot supports 56A, 56B may be used to substantially bear a weight of the cot 10 as it is advanced onto a support object 66, as shown in FIG. 1. The support object 66 may be a platform of an emergency vehicle 11 or any other object capable of supporting a cot 10.

The leg release assembly 14 of the cot 10 controls the ability of at least one of the leading legs 18 and the trailing legs 20 to fold relative to the frame 16. More particularly, in one embodiment the leg release assembly 14 is operable to prevent at least one of the leading legs 18 and the trailing legs 20 from collapsing prior to their disengagement from the leg release assembly 14. Thus, it is contemplated that the leg release assembly 14 may control the ability of one of the leading and trailing legs 18, 20 in one embodiment or both of the leading and trailing legs 18, 20 to fold in another embodiment. It is further contemplated that a single leg release assembly 14 may control the ability of both of the leading and trailing legs 18, 20 to fold. Further, it is contemplated that such folding may occur substantially simultaneously or the folding of the trailing leg 20 may occur delayed, or slightly delayed, from the folding of the leading leg 18 so that the trailing leg 20 provides weight-bearing support to the cot 10 during advancement of the leading end 60 of the frame 16 and the leading leg 18 onto a support object 66.

Figure 2:
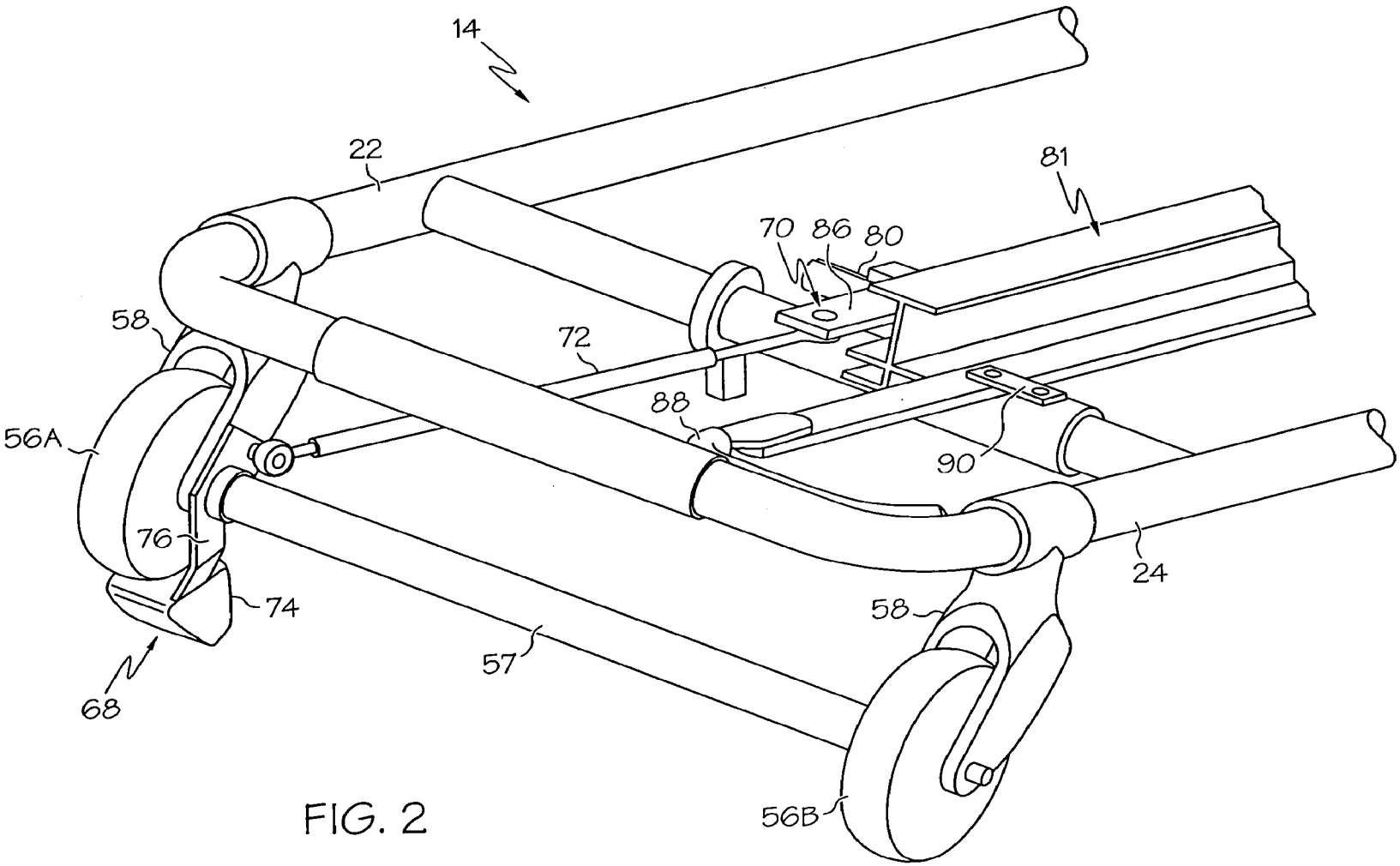
FIG. 2 is a top perspective view of a leg release assembly of a cot according to another embodiment of the present invention.

As shown in FIG. 2, the leg release assembly 14 comprises a contact member 68 pivotally connected to the wheeled transporter 12, a leg release member 70 which operably and releasably engages with at least one of the leading and trailing legs 18, 20, and a linkage member 72 operably connecting the contact member 68 and the leg release member 70. The contact member 68 is pressure-sensitive and activates with an application of pressure thereto to actuate the leg release member 70 so as to initiate a disengagement of the leg release member 70 and permit the at least one of the leading and trailing legs 18, 20 to fold relative to the frame 16.

Figure 3:
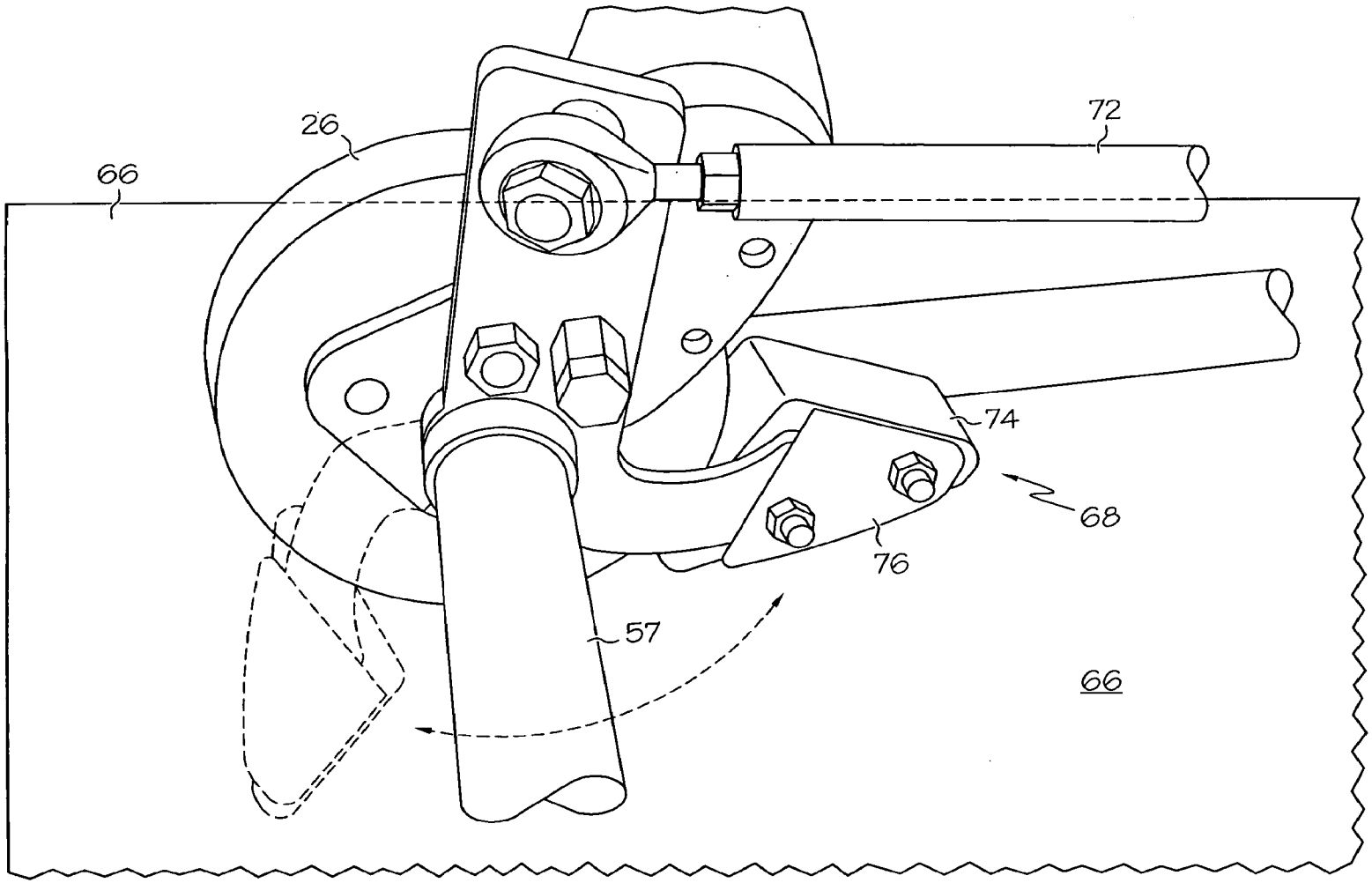
FIG. 3 is a side perspective view of a contact member of a leg release assembly of a cot according to another embodiment of the present invention.

More particularly, as shown in FIGS. 1-3, the contact member 68 generally comprises a bumper 74 and a plate 76 that pivotally connects the bumper 74 to the wheeled transporter 12. The plate 76 positions the bumper 74 so as to contact a support object 66 with an advancement of the cot 10 onto the support object 66 (such as a platform of an emergency vehicle 11 shown in FIG. 1). The plate 76, generally pivotally connected to either a cot support 56A, 56B, if provided, or an axle 57 supporting a cot support 56A, 56B, or proximal to the leading end 60 of the frame 16, allows the bumper 74 to pivot about the plate's connection with the cot support 56A, 56B, or axle 57, or frame 16 with an application of pressure, generally via contact with a support object 66. Thereby, in one embodiment, the contact member 68 activates to permit the automatic folding of the leading legs 18 with the advancement of the cot 10 onto a support object 66 without the need of an operator manually manipulating a release handle which operates on leg release member 70. More particularly, with activation of the contact member 68, via rearward movement of linkage 72, the leg release member 70 disengages from actively securing the leading leg 18, thereby, permitting the leading leg 18 to fold relative to the frame 16 as the cot 10 advances onto the support object 66. In another embodiment, a similar leg release assembly may be provided to also permit the folding of the trailing legs relative to the frame 16 as the cot 10 advances onto the support object 66 without the need of an operator manually manipulating a release handle which operates on a leg release member which secures the trailing legs in the extended position.

As mentioned above, the contact member 68 is pressure-sensitive and activates with an application of pressure thereto. Conversely, it is contemplated in one embodiment that the contact member 68 may deactivate with a release of the application of pressure thereto. In one embodiment, illustrated in FIG. 3, with activation via an application of pressure, the contact member 68 rotates counter-clockwise relative to its connection with the cot support 56A, 56B, or axle 57, or the frame 16 of the wheeled transporter 12. Conversely, with deactivation, the contact member 68 may rotate clockwise relative to its connection with cot support 56A, 56B, or axle 57, or the frame 16 of the wheeled transporter 12 so that the contact member 68 is re-positioned for later contact with a support object 66. It is contemplated in one embodiment, however, that, with activation and/or deactivation, the contact member may rotate clockwise and counter-clockwise, respectively, or otherwise pivot, relative to its connection with the wheeled transporter 12. Further, it is contemplated in another embodiment that the contact member 68 may comprise a spring. The spring of the contact member 68, for example, may tense with the application of pressure to the contact member 68 and may relax with the release of the application of pressure to the contact member 68. As such, as the spring relaxes, it re-positions the contact member 68 for later contact with a support object 66 and may cause, via the linkage member 72, the leg release member 70 to pivot to engage the leading leg 18 or trailing leg 20.

In one embodiment, the leg release member 70 generally is pivotally connected to the wheeled transporter 12, whether to a side frame member 22, 24 or to a trolley assembly, or elsewhere. Thereby, the leg release member 70 may rotate relative to a connection with the wheeled transporter 12 to release the at least one of the leading and trailing legs 18, 20 for movement. It is contemplated, however, in another embodiment that the leg release member 70 may otherwise pivot relative to its connection with the wheeled transporter 12 to release the at least one of the leading and trailing legs 18, 20 for movement.

In one illustrative embodiment of FIG. 2, the leg release member 70 generally comprises a pin 80. In one embodiment, the pin 80 engages and disengages at least one support member (not shown) pivotably connected to the leading legs (not shown) and slidably support by a track 81. More particularly, in one embodiment, the pin 80 engages the support member by advancing through an aperture or recess thereof. Thereby, when engaged, the pin 80 arrests movement of the support member and, as such, prevents the folding of the leading leg 18 connected to the support member. Conversely, retracting the pin 80 from the apertures or recesses of the support member, via actuation of contact member 68, permits movement of the support member and thus permitting folding of the leading legs 18 without the need of an operator manually manipulating a release handle which operates to release the leg release member 70 from securing the leading legs 18. Thus, the pin 80 generally may be advanced and retracted relative to the track 31 to either permit or arrest movement the leading leg 18. It also is contemplated that, in another embodiment, the leg release assembly 70 operates to control movement of the trailing leg 20 instead of the leading legs 18. In still other embodiment, an additional leg release assembly similar to assembly 70 is provide to control movement of the trailing legs 20.

In one embodiment, the pin 80 is spring biased. The spring, for example, may tension with the pin 80 retracts with the activation of the contact member 68 so as to permit the leading leg 18, or the trailing leg 20 in another embodiment, to fold. The spring also may relax so as to advance the pin 80 into engagement with the support member thereby arresting movement thereof and preventing the folding of the leading leg 18, or in another embodiment, the trailing leg 20.

In one embodiment, shown in FIG. 2, the leg release member 70 comprises an actuator mechanism 86 in addition to the pin 80. The pin 80 is connected to the actuator mechanism 86, which is connected to the linkage member 72. Activation of the contact member 68 pivots the linkage member 72, which causes the actuator mechanism 86 to pivot. This pivoting of the actuator mechanism 86 with actuation of the contact member 68 causes the pin 80 to disengage from the support member, thereby, permitting the leading leg 18, or in another embodiment the trailing leg 20, to fold.

It is contemplated that the leg release member 70 may comprise, in the alternative to the pin 80, a latch, a hook, a pawl, or other device operable to perform the purposes of the pin 80 described herein of arresting securely the movement of the respective legs. For example, in another embodiment, shown in FIG. 4, a pair of leg releases 70 are provided. Each leg release member 70 comprises a hooking latch 82 that may pivot to engage and disengage a pin 80 provided to the trolley mechanism 30 to prevent and permit movement thereof along the track 31. Further, the leg release member 70 may comprise a spring 78. The spring 78 may tense with a pivoting of the latch 82 to disengage the leading or trailing trolley assembly from the engagement therewith and may relax with a pivoting of the latch 82 to engage the leading trolley assembly, or in another embodiment trailing trolley assembly. Here, the relaxation of the spring 78 may cause, via the linkage member 72, the contact member 68 to pivot to a deactivated state when it is released from the pressure applied by the support object 66.

The leg release assembly also may comprise a safety catch. The safety catch may be provided as a hook, pawl, pin, or other device operable to engage the leading leg or trailing leg, or a pivotal member connected thereto, so as to prevent collapsing of the leading leg or trailing leg without prior disengagement of the safety catch. The safety catch also may prevent the leading leg or trailing leg to which the safety catch is engaged from collapsing even with activation of the contact member. The safety catch generally is pivotally connected to the wheeled transporter so as to pivot between an engaged state with the leading leg or trailing leg and a disengaged state with the leading leg or trailing leg. A release handle may be provided to control a pivoting of the safety catch between the engaged and disengaged states so that, when disengaged and with activation of the contact mechanism, the leading leg or trailing leg may fold.

Further, as shown in FIG. 4, the leg release assembly 14 may comprise a release handle 88 which is manually actuated by an operator to release a respective leg release 70 in order manually fold the respective legs 18 or 20. A release pivot bar 90 is connected to the release handle 88 and operably connected to both hooking latches 82, such as for example via a cable pull 91. Accordingly, in this manner, an operator pulling on the release handle 88 will cause movement of a release pivot bar 90, which in turn causes both hooking latches 82 to disengage from their respective pins 80, thereby permitting the respective legs to fold relative to the frame 16. It will be appreciated that the handle 88 may be disposed on any location on the wheeled transporter 12 convenient for manual actuation. In other embodiment, a similar manual release mechanism (i.e., release handle 88, pivot bar 90, pull cable 91) is provided to manually release the leg release associated with the trailing legs 20. As such, the release handle 88 may be actuated to pivot the leg release member 70 to disengage from the leading or trailing trolley assembly and permit the leading leg 18 or trailing leg 20 to fold independent of activation of the contact mechanism 68. As such, either the activation of the contact mechanism 68 or the actuation of the release handle 88 may permit at least one of the leading leg 18 and the trailing leg 20 to fold. It is contemplated in another embodiment that the release handle 88 may be operable to pivot, directly or indirectly, the leg release member 70, or a safety catch, or both, in order to permit the at least one of the leading and trailing legs 18, 20 to fold.

In one embodiment, the leg release member 70 controlling the folding of the leading leg 20 is operated automatically by the contact member 68 to release the leading leg 20, while another leg release member 70 associated with the trailing legs 20 is operated by the release handle 88, rather than a contact member 68, to control the collapsing of the trailing leg 20. As such, in one embodiment, after the leading legs 18 of the cot 10 have automatically folded as described above and the cot has been advanced onto the support object 66 such that cot is also supported thereon by wheels 56C, an operator of the cot 10 then will actuate a release handle similar to release handle 88 that permits the trailing legs 20 to fold. It is to be appreciated that with the cot supported by wheels 56A, 56B, and the pair of wheels 56C, on support object 66, the operator is only required to support about ten percent (10%) of the total weight of the cot 10 when the trailing legs are released for folding. This reduced amount of weight greatly improves the easy of cot loading into the emergency vehicle 11, wherein further advancing of the cot 10 onto the support object 66 folds the trailing leg 20 and facilitates a completion of the advancing of the cot 10 onto the support object 66. However, in other cot embodiments comprising a second leg release assembly, as described greater detail below, operation of a release handle 88 is unnecessary as further advancing of the cot 10 onto the support object 66 (either manually by an operator or automatically via cot loading device) activates a second contact member, which permits the collapsing of the trailing leg 20 and facilitates a completion of the advancing of the cot 10 onto the support object 66. This latter embodiment also improves the easy of cot loading into the emergency vehicle by not having to operate a sequence of release handles during loading.

It is contemplated that the cot 10 may be electrically powered, or otherwise driven, so that when the contact member 68 is activated, the at least one of the leading leg 18 and the trailing leg 20 are automatically driven to a collapsed state, rather than simply released from an extended state and permitted to fold when confronted with a support object 66. Further, it is also contemplated that the leg release member 70 may be electrically or electronically directed to release a leg 18, 20 from an engagement therewith, rather than directed mechanically with the activation of the contact member 68 as described herein. For example, in one embodiment, a proximity sensor that identifies a support object 66 within a defined distance may be employed to direct a leg release member 70 to disengage the leading or trailing trolley assembly and permit the leg 18, 20 to fold.

As indicated above and shown in FIG. 2, the linkage member 72 generally is connected directly to both the contact member 68 and the leg release member 70. The linkage member 72 generally is provided as a rigid bar operably connecting the contact member 68 and the leg release member 70. As such, the linkage member 72 is operable to translate pivoting of one of the contact member 68 and leg release member 70 into pivoting of the other of the contact member 68 and leg release member 70. More particularly, the linkage member 72 is operable to translate activity of one of the contact member 68 and the leg release member 70 to the other of the contact member 68 and the leg release member 70 such that the activity of the other of the contact member 68 and the leg release member 70 coordinates with the activity of the one of the contact member 68 and the leg release member 70 in permitting or preventing the folding of the at least one of the leading leg 18 and the trailing leg 20. The activity of the contact member 68 generally comprises activation and deactivation thereof and the activity of the leg release member 70 generally comprises engaging and disengaging the leading or trailing trolley assembly.

Further, it is contemplated that a cot 10 may comprise a second leg release assembly. As such, the leg release assembly 14 may be provided to control the collapsing of the leading leg 18, while the second leg release assembly may be provided to control the collapsing of the trailing leg 20. This second leg release assembly comprises a second contact member pivotally connected to the wheeled transporter 12, a second leg release member releasable engaged with the trailing leg 20, and a linkage member operably connection the second contact member and the second leg release member. The leading leg 18 folds relative to the frame 16 with activation of the contact member 68 and disengagement of the leg release member 70 from the leading trolley assembly 30, while the trailing leg folds relative to the frame 16 with activation of the second contact member and disengagement of the second leg release member from the trailing trolley assembly. The second contact member may be positioned near the midsection area 62 of the frame 16 so that the leading leg 18 and the trailing leg 20 fold in sequence, and not simultaneously, with the advancing of the cot 10 onto the support object 66. This reduces the amount of load and stress on an operator of the cot 10 when advancing the cot 10 onto a support object, such as a platform in an emergency vehicle. It is contemplated, however, that the second leg assembly may be positioned or configured such that the leading leg 18 and the trailing leg 20 may fold simultaneously if so desired. In still another embodiment, the second release assembly may comprises a pair of release assemblies 70, such as shown by FIG. 4.

In still another embodiment, the second leg release assembly may be configured or operated differently than the leg release assembly 14 described herein. For example, one potentially suitable second leg release assembly is described by commonly owned and co-pending U.S. Pat. No. 7,424,758, entitled ROLL-IN COT, and which the disclosure thereof is herein fully incorporated by reference.

Based on the foregoing, it is contemplated that: the leg release assembly 14 automatically releases at least one of the leading and trailing legs 18, 20 during the advancing of the cot 10 onto a platform in an emergency vehicle; the leg release assembly 14 may be wholly contained within the cot 10; the leg release member is pivoted to release at least one of the leading and trailing legs 18, 20 from an engagement therewith activation of the contact member 68; when the contact member 68 contacts a loading area/platform of the emergency vehicle with a sufficient application of pressure to the contact member 68, the collapsing of the at least one of the leading and trailing legs 18, 20 is permitted; the activation of the contact member pivots the leg release member 70 to engage a trolley assembly to secure at least one of the leading and trailing legs 18, 20 in an extended state relative to the frame 16; the contact member 68, or multiple contact members 68, pivots leg release members 70 for disengagement from multiple legs 18, 20 simultaneously or sequentially; in one embodiment, pivoting the contact member 68 pivots a pin 80 to retract from a trolley assembly connected to the leading leg 18 or trailing leg 20 to allow the leg 18, 20 to fold; and when removing the cot 10 from an emergency vehicle 11, the leg release assembly 14 operates in a sequence reverse of that described above to permit extension of the legs 18, 20 become re-engaged by the leg release member 70 to facilitate ground transportation of the cot 10.

Further, it is contemplated that, another embodiment involves a method of loading a cot onto a support object. The method generally comprises advancing a cot onto a support object, contacting a contact member pivotally connected to a wheeled transporter of the cot with the support object to pivot and activate the contact member, wherein activation of the contact member causes a leg release member of the cot to automatically disengage from a leading leg of the wheeled transporter to permit the leading leg to fold, and further advancing the cot onto the support object to fold the leading leg. The method may further comprise actuating a release handle to pivot a second leg release member to disengage from a trailing leg of the wheeled transporter to permit the trailing leg to fold, and further advancing the cot onto the support object to fold the trailing leg, and to complete the advancing of the cot onto the support object. In another embodiment, a second contact member may be used to automatically disengage from the trailing leg to permit it to fold.

It should be understood that the particular construction of the cot 10, including the wheeled transporter 12, is for purposes of illustrating a leg release assembly 14 for automatically permitting the folding of the legs 18, 20 of the cot 10 according to embodiments of the present invention. The leg release assembly 14 may be adapted for use in any of a number of other roll-in adjustable cot configurations, including cots with adjustable load heights. For purposes of explanation and illustration, however, the cot configuration shown in FIG. 1 is used.

Persons skilled in the art will appreciate that the embodiments described herein may be subject to various improvements and/or modifications that may be apparent without departing from the spirit and scope of these embodiments.

The invention claimed is:

1. A cot comprising a wheeled transporter and a leg release assembly, wherein:

the wheeled transporter comprises a frame, a leading leg pivotally connected to the frame, and a trailing leg pivotally connected to the frame;

the leg release assembly comprises a contact member pivotally connected to the wheeled transporter, a pivotal leg release member releasably engaged with at least one of the leading leg and the trailing leg, and a linkage member operably connecting the contact member and the leg release member;

the contact member is pressure-sensitive and activates with an application of pressure thereto;

the leg release member pivots to disengage from the at least one of the leading leg and the trailing leg with activation of the contact member; and the at least one of the leading leg and the trailing leg folds relative to the frame with disengagement from the leg release member, wherein the leg release assembly further comprises a release handle actuatable to permit at least one of the leading leg and the trailing leg to fold relative to the frame independent of the activation of the contact member.

2. The cot of claim 1, wherein:

the frame comprises a leading trolley assembly and a trailing trolley assembly, the leading trolley assembly and the trailing trolley assembly share a common track and respectively comprise at least one pivotal member, and the leading leg is pivotally connected to the pivotal member of the leading trolley assembly and the trailing leg is pivotally connected to the pivotal member of the trailing trolley assembly.

3. The cot of claim 2, wherein the leg release member releasably engages at least one of the leading trolley assembly and the trailing trolley assembly and disengages from the at least one of the leading trolley assembly and the trailing trolley assembly with activation of the contact member such that the at least one of the leading leg and the trailing leg folds relative to the frame.

4. The cot of claim 1, wherein the leg release member comprises a spring that tenses with a pivoting of the leg release member to disengage from the at least one of the leading and trailing legs and relaxes with a pivoting of the leg release member to engage the at least one of the leading and trailing legs.

5. The cot of claim 4, wherein contact member deactivates when released from the application of pressure thereto with the pivoting of the leg release member to engage the at least one of the leading and trailing legs.

6. The cot of claim 1, wherein the contact member comprises a spring that tenses with activation of the contact member with the application of pressure thereto and relaxes with a deactivation of the contact member with a release of the application of pressure thereto.

7. The cot of claim 6, wherein the leg release member pivots to engage the at least one of the leading leg and the trailing leg with the deactivation of the contact member.

8. The cot of claim 1, wherein:

the linkage member translates activity of one of the contact member and the leg release member to the other of the contact member and the leg release member such that the activity of the other of the contact member and the leg release member coordinates with the activity of the one of the contact member and the leg release member in releasing or securing the at least one of the leading leg and the trailing leg, and the activity of the contact member comprises activation and deactivation thereof and the activity of the leg release member comprises engaging and disengaging the at least one of the leading leg and the trailing leg.

9. The cot of claim 1, wherein:

the contact member is positioned to contact a support object with an advancement of the cot onto the support object, and the contact of the support object against the contact member with the advancement of the cot onto the support object activates the contact member such that at least one of the leading leg and the trailing leg folds relative to the frame.

10. The cot of claim 1, wherein the cot further comprises a patient support mounted on a top of the frame of the wheeled transporter.

11. The cot of claim 1, wherein:

the wheeled transporter further comprises a cot support connected proximally to a leading end of the frame, and the contact member is pivotally connected to the cot support such that the contact member pivots relative to the cot support with the application of pressure to the contact member.

12. The cot of claim 11, wherein the cot further comprises one or more cot supports connected proximally to at least one of a midsection area of the frame and a trailing end of the frame.

13. The cot of claim 1, wherein the leg release assembly further comprises a safety catch that prevents at least one of the leading leg and the trailing leg from collapsing prior to a disengagement of the safety catch.

14. The cot of claim 1, wherein:

the cot comprises a second leg release assembly comprising a second contact member pivotally connected to the wheeled transporter, a second leg release member releasably engaged with the trailing leg, and a linkage member operably connecting the second contact member and the second leg release member, the leg release assembly releasably engages the leading leg such that the leading leg folds relative to the frame with activation of the contact member, and the second leg release assembly releasably engages the trailing leg such that the trailing leg folds relative to the frame with activation of the second contact member.

15. The cot of claim 1, wherein the contact member is positioned to contact a support object with an advancement of the cot onto the support object, and the contact of the support object against the contact member with the advancement of the cot onto the support object activates the contact member such that at least one of the leading leg and the trailing leg folds automatically relative to the frame.

16. A cot comprising a wheeled transporter and a leg release assembly, wherein:

the wheeled transporter comprises a frame, a leading leg pivotally connected to the frame, and a trailing leg pivotally connected to the frame;

the leg release assembly comprises a contact member pivotally connected to the wheeled transporter, a pivotal leg release member releasably engaged with at least one of the leading leg and the trailing leg, and a linkage member operably connecting the contact member and the leg release member;

the contact member is pressure-sensitive and activates with an application of pressure thereto;

the leg release member pivots to disengage from the at least one of the leading leg and the trailing leg with activation of the contact member; and the at least one of the leading leg and the trailing leg folds relative to the frame with disengagement from the leg release member, wherein the leg release assembly further comprises a release handle actuatable to permit at least one of the leading leg and the trailing leg to fold relative to the frame independent of the activation of the contact member, and wherein:

the wheeled transporter further comprises a cot support connected proximally to a leading end of the frame, and the contact member is pivotally connected to the cot support such that the contact member pivots relative to the cot support with the application of pressure to the contact member.

* * * * *

UNITED STATES PATENT AND TRADEMARK OFFICE

CERTIFICATE OF CORRECTION

PATENT NO. : 8,640,283 B2
APPLICATION NO. : 12/811739
DATED : February 4, 2014
INVENTOR(S) : Gavin Broadley et al.

It is certified that error appears in the above-identified patent and that said Letters Patent is hereby corrected as shown below:

In The Specification

Col. 3, Line 21,
"respective legs 18, 20 may be splayed, i.e. a pair of leading" should read
--respective legs 18, 20 may be displayed, i.e. a pair of leading--;

Col. 4, Line 56,
"comprise trailing cross-supports MA, MB to provide added" should read
--comprise trailing cross-supports 54A, 54B to provide added--;

Col. 4, Line 63,
"The cot supports 56A, 56B may mounted to the frame 16 with" should read
--The cot supports 56A, 56B may be mounted to the frame 16 with--;

Col. 6, Line 61,
"the track 31 to either permit or arrest movement the leading" should read
--the track 31 to either permit or arrest movement of the leading--;

Col. 7, Line 57,
"manually fold the respective legs 18 or 20. A release pivot bar" should read
--to manually fold the respective legs 18 or 20. A release pivot bar--;

Col. 8, Line 37,
"release assembly, as described greater detail below, operation" should read
--release assembly, as described in greater detail below, operation--;

Col. 8, Line 44,
"also improves the easy of cot loading into the emergency" should read
--also improves the ease of cot loading into the emergency--;

Signed and Sealed this
Seventeenth Day of March, 2015

Michelle K. Lee

Michelle K. Lee
*Director of the United States Patent and Trademark Office*

Col. 9, Line 24,
"ing leg 20, and a linkage member operably connection the" should read
--ing leg 20, and a linkage member operably connecting the--; and Col. 9, Line 43,
"comprises a pair of release assemblies 70, such as shown by" should read
--comprise a pair of release assemblies 70, such as shown by--.

UNITED STATES PATENT AND TRADEMARK OFFICE

CERTIFICATE OF CORRECTION

PATENT NO. : 8,640,283 B2
APPLICATION NO. : 12/811739
DATED : February 4, 2014
INVENTOR(S) : Gavin Broadley et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 499 days.

Signed and Sealed this
Ninth Day of June, 2015

Michelle K. Lee

Michelle K. Lee
*Director of the United States Patent and Trademark Office*